US010648195B2

(12) United States Patent
Minter et al.

(10) Patent No.: US 10,648,195 B2
(45) Date of Patent: May 12, 2020

(54) SIDE ACTION FLUSH LOCK FOR CASEMENT WINDOW AND METHOD OF OPERATING THE SAME

(71) Applicant: INTERLOCK USA, INC., Reno, NV (US)

(72) Inventors: Peter J. Minter, Reno, NV (US); Mathew D. Ruspil, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 267 days.

(21) Appl. No.: 15/625,596

(22) Filed: Jun. 16, 2017

(65) Prior Publication Data

US 2017/0298650 A1 Oct. 19, 2017

Related U.S. Application Data

(60) Continuation-in-part of application No. 14/793,820, filed on Jul. 8, 2015, now Pat. No. 9,777,509, which
(Continued)

(51) Int. Cl.
*E05B 5/00* (2006.01)
*E05C 9/10* (2006.01)
(Continued)

(52) U.S. Cl.
CPC ..... *E05B 5/006* (2013.01); *E05B 9/08* (2013.01); *E05B 15/0006* (2013.01); *E05C 9/10* (2013.01); *E05B 5/00* (2013.01); *E05B 15/0073* (2013.01); *E05B 15/0086* (2013.01); *E05C 1/00* (2013.01); *E05C 1/004* (2013.01); *E05C 1/006* (2013.01);
(Continued)

(58) Field of Classification Search
CPC ..... E05C 17/14; E05C 9/02; E05C 19/028; E05C 1/00; E05C 1/002; E05C 1/004; E05C 1/006; E05C 1/02; E05C 1/08; E05C 17/48; E05C 2001/008; E05C 9/028; E05C 9/20; E05C 9/22; E05C 9/10; E05C 19/10; Y10T 292/0951; Y10T 292/0963; Y10T 292/0967; Y10T 292/0968; E05B 5/0006; E05B 5/00; E05B 15/0006; E05B 85/22; E05B 5/006; E05B 9/08; E05B 15/0073; E05B 15/0086
USPC ..... 292/DIG. 31, 101, 158, 161, 162, 292/DIG. 47
See application file for complete search history.

(56) References Cited

U.S. PATENT DOCUMENTS 3,302,434 A 2/1967 Dauenbaugh et al.
3,492,037 A 1/1970 Hutchinson
(Continued)

*Primary Examiner* — Carlos Lugo
*Assistant Examiner* — Faria F Ahmad
(74) *Attorney, Agent, or Firm* — DeLio Peterson & Curcio LLC; David R. Pegnataro

(57) ABSTRACT

A low profile actuating window lock for casement windows having a longitudinal slot in a sidewall of the casing for the lock, wherein a fork component translates within the slot in a direction perpendicular to an axis of rotation of the handle and the handle rotates along a plane perpendicular to the fork component, the handle pivotable about a restrictor arm that pivots relative to the casing, allowing the handle to rotate fully from the locked position to the unlocked position with low clearance from the window frame. The pivot points of the handle and restrictor arm configuration allow for an over center linkage that prevents back driving the casement window lock.

12 Claims, 10 Drawing Sheets

Related U.S. Application Data is a division of application No. 13/610,789, filed on Sep. 11, 2012, now Pat. No. 9,109,384.

(51) Int. Cl.

| | |
|---|---|
| ***E05B 9/08*** | (2006.01) |
| ***E05B 15/00*** | (2006.01) |
| ***E05C 9/02*** | (2006.01) |
| ***E05C 1/00*** | (2006.01) |
| ***E05C 9/22*** | (2006.01) |
| ***E05C 19/10*** | (2006.01) |
| ***E05C 9/20*** | (2006.01) |
| ***E05C 1/02*** | (2006.01) |
| ***E05C 19/02*** | (2006.01) |
| ***E05C 17/14*** | (2006.01) |
| ***E05C 17/48*** | (2006.01) |
| ***E05C 1/08*** | (2006.01) |

(52) U.S. Cl.

CPC *E05C 1/02* (2013.01); *E05C 1/08* (2013.01); *E05C 9/02* (2013.01); *E05C 9/20* (2013.01); *E05C 9/22* (2013.01); *E05C 17/14* (2013.01); *E05C 17/48* (2013.01); *E05C 19/028* (2013.01); *E05C 19/10* (2013.01); *E05C 2001/008* (2013.01); *Y10T 292/0951* (2015.04); *Y10T 292/0963* (2015.04); *Y10T 292/0967* (2015.04); *Y10T 292/0968* (2015.04)

(56) References Cited

U.S. PATENT DOCUMENTS

| | | | | | |
|---|---|---|---|---|---|
| 3,949,525 | A | | 4/1976 | Bates et al. | |
| 4,674,777 | A | | 6/1987 | Guelck | |
| 4,803,808 | A | | 2/1989 | Greisner | |
| 4,823,508 | A | | 4/1989 | Allen | |
| 4,937,976 | A | | 7/1990 | Tucker et al. | |
| 4,976,066 | A | | 12/1990 | Plummer et al. | |
| 4,991,886 | A | | 2/1991 | Nolte et al. | |
| 5,050,345 | A | | 9/1991 | Nakanishi | |
| 5,054,239 | A | | 10/1991 | Tucker et al. | |
| 5,118,145 | A | | 6/1992 | Tucker | |
| 5,152,103 | A | * | 10/1992 | Tucker | E05F 11/16 49/279 |
| 5,087,087 | A | | 11/1992 | Vetter et al. | |
| 5,219,195 | A | | 6/1993 | Lawrence | |
| 5,318,333 | A | | 6/1994 | Dreifert | |
| 5,323,568 | A | | 6/1994 | Blomqvist | |
| 5,370,428 | A | | 12/1994 | Dreifert et al. | |
| 5,531,045 | A | | 7/1996 | Piltingsrud | |
| 5,570,915 | A | * | 11/1996 | Asadurian | E05B 17/0037 292/216 |
| 5,618,068 | A | | 4/1997 | Mitsui et al. | |
| D388,689 | S | | 1/1998 | Bauman et al. | |
| D390,445 | S | | 2/1998 | Johnson et al. | |
| 5,730,477 | A | * | 3/1998 | Nagy | E05F 11/08 292/32 |
| 5,741,031 | A | | 4/1998 | Bauman et al. | |
| 5,778,602 | A | | 7/1998 | Johnson et al. | |
| 5,813,710 | A | | 9/1998 | Anderson | |
| 5,829,802 | A | | 11/1998 | Anderson et al. | |
| 5,927,768 | A | | 7/1999 | Dallmann et al. | |
| 6,109,668 | A | | 8/2000 | Demarco | |
| 6,230,457 | B1 | | 5/2001 | Brautigam | |
| 6,354,639 | B1 | | 3/2002 | Minter et al. | |
| 6,367,853 | B1 | | 4/2002 | Briggs | |
| 6,425,611 | B1 | | 7/2002 | Minter et al. | |
| 6,431,620 | B2 | | 8/2002 | Tremblay et al. | |
| 6,434,887 | B2 | * | 8/2002 | Nakanishi | E05D 15/30 49/246 |
| 6,450,554 | B1 | | 9/2002 | Rotondi et al. | |
| 6,651,389 | B2 | | 11/2003 | Minter et al. | |
| 6,672,010 | B1 | | 1/2004 | Gledhill et al. | |
| 6,767,038 | B1 | | 7/2004 | Humi | |
| 6,837,004 | B2 | | 1/2005 | Annes | |
| 7,617,707 | B2 | | 11/2009 | Chiang | |
| 7,708,322 | B2 | | 5/2010 | Timothy et al. | |
| 7,823,935 | B2 | | 11/2010 | Norris et al. | |
| 7,900,322 | B2 | | 3/2011 | Doring et al. | |
| 7,946,633 | B2 | | 5/2011 | Minter | |
| 8,353,541 | B2 | | 1/2013 | Minter | |
| 8,448,996 | B2 | | 5/2013 | Lake et al. | |
| 8,683,746 | B2 | * | 4/2014 | Lambertini | E05F 11/16 49/246 |
| 8,726,572 | B2 | | 5/2014 | Derham | |
| 9,109,384 | B2 | * | 8/2015 | Minter | E05C 19/10 |
| 9,777,509 | B2 | * | 10/2017 | Minter | E05C 19/10 |
| 2001/0013202 | A1 | | 8/2001 | Nakanishi et al. | |
| 2002/0066162 | A1 | | 6/2002 | Klompenburg et al. | |
| 2003/0079414 | A1 | | 5/2003 | Rangabasyam et al. | |
| 2005/0223524 | A1 | * | 10/2005 | Muir | E05D 15/30 16/366 |
| 2008/0256874 | A1 | | 10/2008 | Curtis et al. | |
| 2012/0036781 | A1 | | 2/2012 | Runk et al. | |
| 2012/0180392 | A1 | | 7/2012 | Lambertini | |
| 2013/0104458 | A1 | | 5/2013 | Leung et al. | |
| 2014/0070547 | A1 | * | 3/2014 | Minter | E05C 19/10 292/101 |
| 2016/0060919 | A1 | | 3/2016 | Vetter | |

* cited by examiner

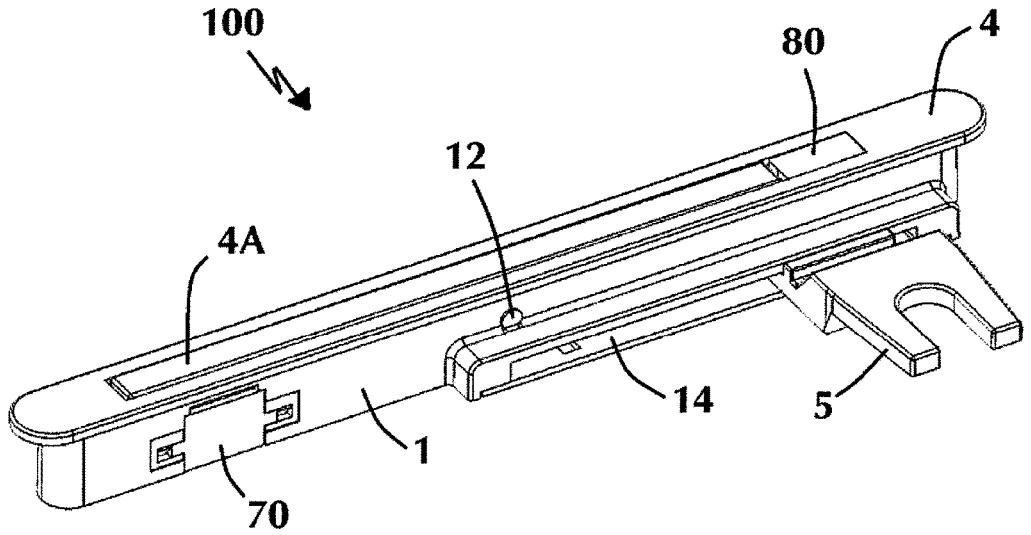
FIG. 1
FIG. 3
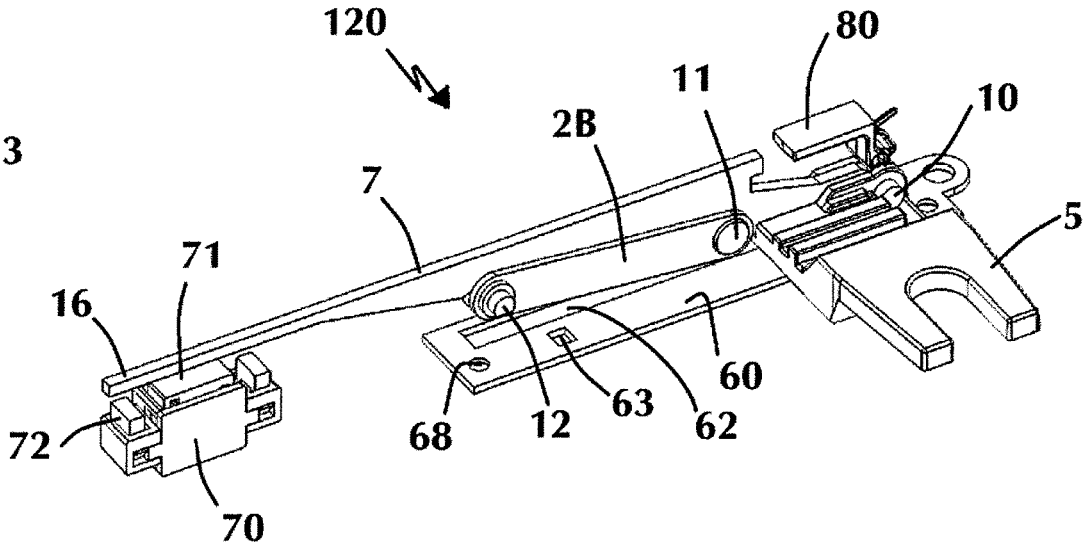

7

SIDE ACTION FLUSH LOCK FOR CASEMENT WINDOW AND METHOD OF OPERATING THE SAME

RELATED APPLICATIONS

This application is a continuation-in-part of U.S. patent application Ser. No. 14/793,820 filed Jul. 8, 2015, which is a divisional application of U.S. patent application Ser. No. 13/610,789 filed Sep. 11, 2012.

BACKGROUND OF THE INVENTION

1. Field of the Invention

The present invention is directed towards window locks, and more particularly toward manual handles for actuating window locks. Specifically, the present invention is directed to a flush mounted or low profile actuating window lock for casement windows. More specifically, the present invention is directed to a flush mounted lock actuator designed to drive a lock bar that locks and unlocks a casement window, which protrudes from the window frame significantly less than prior art designs, while employing an action which operates at 90 degrees to the pivoting handle.

2. Description of Related Art

Generally, a casement window is a window unit in which the single vent cranks outward, to the right or left. Casement windows are hinged at the side. (Windows hinged at the top are referred to as awning windows.) They are used singly or in pairs within a common frame. Casement windows are often held open using a casement stay. Casement windows open like doors. Like doors, either the left or right side is hinged (or, more accurately, pivoted), and the non-hinged side locks securely into place by a lock bar driven by a lock handle. Unlike a door, the casement window opens not by a knob or handle but by means of some variation of a gear driven operator or lever, which is placed around hand height or at the bottom. A gear driven operator, stay, or friction hinge controlling the position of the sash is necessary when the window opens outward, to hold the window in position during inclement weather, such as high winds.

The locking system for a casement window is typically on the side of the window. Lock handles for casement windows are known in the art. Generally, a lock handle is mounted on the frame of the casement window and moves an internally mounted fork component left or right. The fork component drives a lock or tie bar that is also mounted to the frame. One type of locking mechanism for a casement window uses a flat tie bar slidably mounted to the window frame along the open side of the window. The tie bar is provided with multiple pins for locking and driving that extend perpendicularly outward from the tie bar. A locking handle is provided on the interior of the window frame that can be thrown by the user between locked and unlocked positions. The locking handle slides the tie bar, which moves each locking pin between a corresponding locked and unlocked position. A typical lock bar and lock handle to drive the lock bar is shown in U.S. Pat. No. 7,946,633, entitled "Low Friction Adjustable Roller Pin," issued to Minter on May 24, 2011.

Lock handles of the prior art are known to protrude from the casement window frame at a distance of approximately 20-25 mm. This protrusion is due to the internal driving mechanism within the handle. Casement window lock handles of the prior art drive a fork component, which engages and slides the lock bar. In order to drive the fork component from one side to the other, the handle casing must have sufficient depth to allow for the handle to pivot about the casing and to allow the fork internally to shift from side to side.

The most relevant prior art does not teach or disclose a locking mechanism capable of low profile (on the order of 8 mm) flush mounting that can be adapted to work with existing tie bar locking designs. For example, in U.S. Pat. No. 5,087,087 issued to Vetter, et al., on Feb. 11, 1992, entitled "Sash Lock," a basic multipoint window lock mechanism is taught using an actuating lever/handle that drives a sliding lock bar. The actuating lever handle has a pin located at the opposite end from the handle end. The pin is engaged in and drives a fork component on the lock bar. This prior art does not disclose, describe, or suggest any type of lifter mechanism in combination with the fork component to achieve a significantly reduced profile lock actuation. Nor does this prior art design introduce additional linkage to prevent back driving the lock.

In U.S. Pat. No. 5,813,710 issued to Anderson on Sep. 29, 1998, entitled "Flush Lock Actuator," a lock actuator is disclosed to provide a "flush" lock appearance. However, for reasons discussed further herein, the low profile feature of this invention is provided with a design distinctly different from the present design. The Anderson design teaches a handle that is symmetrical and flush with the body of the actuator. The handle is pivoted with respect to the casing about its center on a pin. One end of the handle pivots towards (and into) the window frame, while the other end pivots out of the body and away from the frame. The end that pivots into the window has an actuating link attached to it that drives the lock bar. There is no restrictor arm for redirecting the pivot points of the handle to work in combination with a fork component to reduce the casing profile as taught by the present invention, nor is there a rotatable connector to prevent "over-opening" the lock.

In U.S. Pat. No. 5,829,802 issued to Anderson, et al., on Nov. 3, 1998, entitled "Multi-Point Lock Operator For Casement Window," a lock actuator is disclosed that drives a multipoint lock bar. Although the actuator handle is not flush, the handle swings a full 180° so that it lies flat at both the locked and unlocked limits of motion. The far end of the actuator handle drives a "universal" link that is connected to the lock bar. In this design, the handle is pivoted directly on the casing or body of the device, which is distinctly different than the present design. Consequently, there is no need for a restrictor arm or any additional linkage for over center security to prevent the lock handle from being back driven.

In general, the prior art is silent with respect to salient features of the present invention that achieve flush mounting and prevent back driving the lock.

SUMMARY OF THE INVENTION

Bearing in mind the problems and deficiencies of the prior art, it is therefore an object of the present invention to provide a casement window lock that is flush mounted with a significantly lower profile than the current state of the art.

It is a further object of the present invention to provide a casement window lock that allows for complete reversal of the handle from the locking position to the unlocking position, and vice versa.

In yet another object of the present invention, it is desirable to provide a casement window lock that prevents back driving the locking mechanism.

The above and other objects, which will be apparent to those skilled in the art, are achieved in the present invention which is directed to a method of unlocking a casement window having an elongated casing with a substantially horizontal sidewall section including a longitudinal slot for receiving a fork component, and a restrictor arm pivotally attached at one end to the casing and pivotally attached at the other end to a handle at a first pivot point. A fork component is adapted to engage a lock bar external to the lock, and the fork component is in slidable communication with the casing within the longitudinal slot. A handle is pivotally attached at one end to the fork component at a second pivot point and pivotally attached at an intermediate point on the handle to the restrictor arm, and the handle is rotatable along a plane perpendicular to the fork component. The method comprises rotating the handle about the first pivot point to move the fork component and the second pivot point horizontally along the casing horizontal sidewall section within the longitudinal slot in a direction perpendicular to an axis of rotation of the handle, while simultaneously shifting the first pivot point relative to the second pivot point to allow said handle to rotate from an initial position.

The elongated casing may comprise a spring action push mechanism including a permanent magnet embedded at an end opposite the handle second pivot point and the handle may include a second end having a permanent magnet of opposite polarity to the first permanent magnet embedded therein, wherein magnetic attraction between the permanent magnets maintains the handle in a flush position within the casing when the handle is in a locked position. The method may further include the step of pulsing the handle second end in the direction of the casing to compress a spring within the push mechanism such that upon release of the spring, energy stored in the compressed spring is sufficient to overcome the magnetic attraction between the first and second permanent magnets to release the handle for rotation.

In an embodiment, the method may include causing an over-center condition by rotating the handle from a fully unlocked position wherein a first hinge point, rotatably joining the handle to the fork component, is placed between a second hinge point, rotatably joining the handle to the restrictor arm, and a third hinge point, rotatably joining the restrictor arm to the casing, and the second hinge point is above an action line connecting the first and third hinge points, and thereafter causing said over-center condition by rotating the handle fully to a locked position such that the second hinge point is placed between the first and third hinge points, and the second hinge point is below an action line connecting the first and third hinge points.

In another aspect, the present invention is directed to a method of securing a window sash to a casement window frame, comprising actuating a flush lock for the casement window, wherein the casement window includes an elongated casing having a substantially horizontal sidewall section including a longitudinal slot for receiving a fork component adapted to engage a lock bar external to the lock, the fork component in slidable communication with the casing within the longitudinal slot. The flush lock further includes a restrictor arm pivotally attached to the casing, and a plurality of hinges or pivot points forming an over center linkage to prevent back driving the lock, wherein the over center linkage includes, a first hinge point rotatably joining the handle to the fork component, a second hinge point rotatably joining the handle to the restrictor arm, and a third hinge point rotatably joining the restrictor arm to the casing. A handle is pivotally attached at one end to the fork component, and pivotally attached at an intermediate point on the handle to the restrictor arm, and the handle is rotatable along a plane perpendicular to the fork component. The method comprises rotating the handle to an unlocked position, such that the first hinge point is between the second and third hinge points and the second hinge point is above an action line connecting the first and third hinge points, or rotating the handle to a locked position, such that the second hinge point is between the first and third hinge points and the second hinge point is below an action line connecting the first and third hinge points, and moving the fork component horizontally along the casing horizontal sidewall section within the longitudinal slot in a direction perpendicular to an axis of rotation of the handle.

In yet another aspect, the present invention is directed to a casement window lock for securing a window sash to a casement window frame, the lock comprising a casing having a substantially horizontal sidewall section including a longitudinal slot, a restrictor arm pivotally attached at one end to the casing and pivotally attached at the other end to a handle at a first pivot point, a fork component including an attachment portion for engaging a lock bar and a protrusion for slidably engaging the longitudinal slot, and a handle in pivotal communication with the fork component at one end of the handle at a second pivot point and in pivotal communication with the restrictor arm at an intermediate point on the handle, the handle rotatable along a plane perpendicular to the fork component. When the handle is rotated to an unlocked position, the handle pivots about the first pivot point, causing the fork component and the second pivot point to traverse horizontally within the longitudinal slot in a first direction perpendicular to an axis of rotation of the handle, and when the handle is rotated to a locked position, the handle pivots about the first pivot point in an opposite direction, causing the fork component and the second pivot point to traverse horizontally within the longitudinal slot in a second direction opposite the first direction.

The casement window lock may include a plurality of hinges or pivot points forming an over center linkage to prevent back driving the lock. The over center linkage may include a first hinge point rotatably joining the handle to the lifter, a second hinge point rotatably joining the handle to the restrictor arm, and a third hinge point rotatably joining the restrictor arm to the casing, such that when the handle is in an unlocked position, the first hinge point is between the second and third hinge points and the second hinge point is above an action line connecting the first and third hinge points, and when the handle is in the locked position, the second hinge point is between the first and third hinge points and the second hinge point is below an action line connecting the first and third hinge points.

In an embodiment, the casement window lock may further include a retainer for securing the lock to a window frame, wherein the retainer is placed on a window frame opposite the casement window lock and providing a surface for mounting screws through the window frame to the lock. The retainer may comprise a slot extending along a length thereof for receiving at least a portion of the fork component extending therethrough as the fork component traverses in the first and second directions. The retainer may further comprise at least one detent formed therein to engage a detent spring coupled to the fork component and located between the fork component and the retainer, the detent spring providing tactile and audible indication that the fork component has reached an end of travel.

A spring washer may be attached between the restrictor arm and the casing, the spring washer capable of providing force at minimal deflection.

The casement window lock may further comprise a spring action push mechanism including a permanent magnet embedded in the casing at an end opposite the handle second pivot point and the handle may include a second end having a permanent magnet of opposite polarity to the first permanent magnet embedded therein, wherein magnetic attraction between the permanent magnets maintains the handle in a flush position within the casing when the handle is in a locked position. The handle is releasable for rotation by pulsing an end of the handle in the direction of the casing to compress a spring within the push mechanism such that upon release of the spring, energy stored in the compressed spring is sufficient to overcome the magnetic attraction between the first and second permanent magnets.

A snap-on escutcheon may be attached to the casing and the handle, and the casement window lock may further include a rotatable connector for preventing the handle from over-rotating and contacting the casing and/or escutcheon and ensuring clearance therebetween as the handle is rotated to an unlocked position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 1 depicts a perspective view of an embodiment of the flush lock handle mechanism casement window lock of the present invention, with the handle in the closed position;

FIG. 3 is a right side perspective view of a sub-assembly of the flush lock mechanism of FIG. 1 showing the connection scheme of the handle, spring action push mechanism, restrictor arm, and fork. The escutcheon and main casing have been removed, for clarity;

DESCRIPTION OF THE EMBODIMENT(S)

Figure 2:
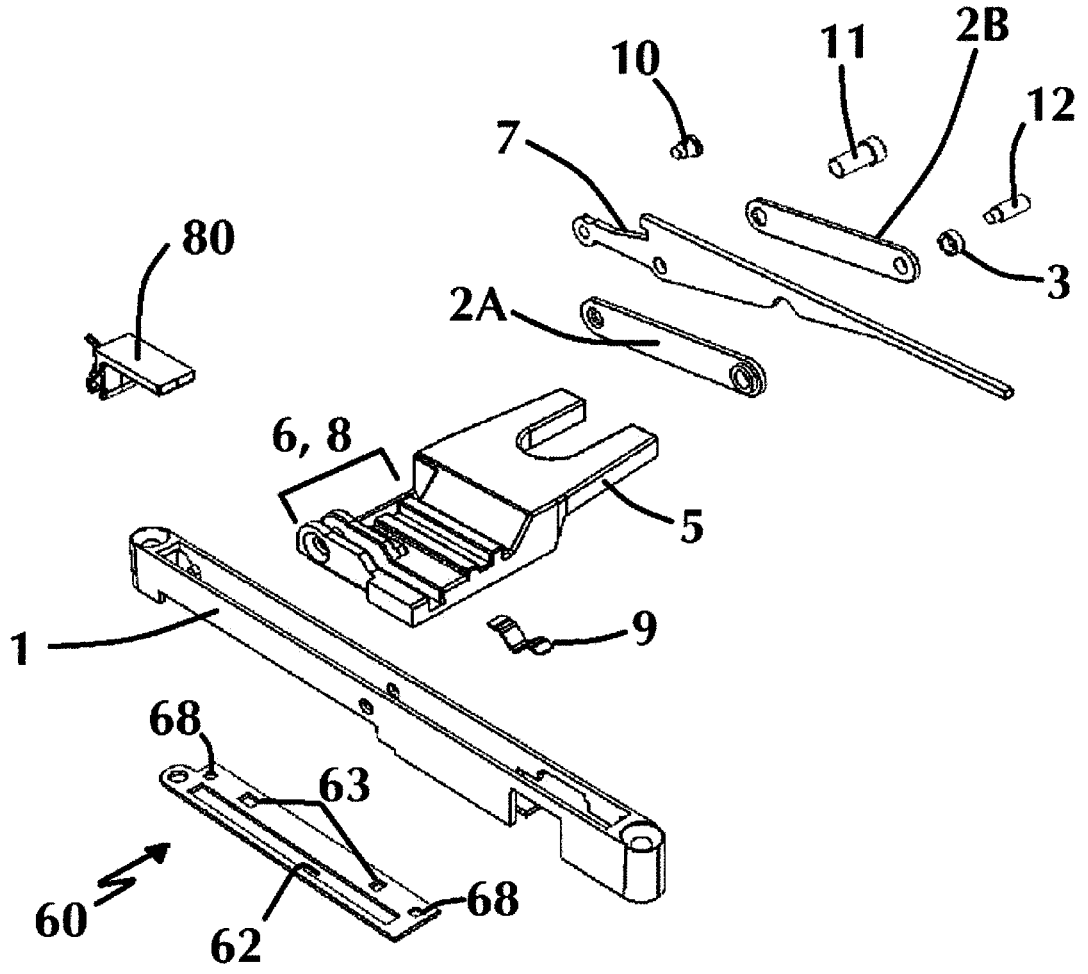
FIG. 2 is an exploded view of the flush lock handle mechanism of FIG. 1. The escutcheon and spring action push mechanism are not shown, for clarity.

In describing the embodiments of the present invention, reference will be made herein to FIGS. 1-15 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," and "downward" merely describe the configuration shown in the drawings. For purposes of clarity, the same reference numbers will be used in the drawings to identify similar elements.

The lock of the present invention is a low profile, flush design, that protrudes from the window frame significantly less than the prior art, at about 8 mm compared to 25 mm in the current prior art designs. When locking a casement window, the window is closed generally by a crank. The strikes on the moving sash are brought close to the pins on a tie bar mounted to the non-moving window frame. The lock handle is then thrown. This drives a fork component within the lock, which engages the tie bar and drives it, moving the tie bar pins into engagement with corresponding hooks or strikes. The fork component is preferably a flat structure adapted to slide within the lock casing, preferably having two extensions, such as leg portions, for engaging a tie bar. The strikes generally have a ramp surface at their mouth and the pins slide up this ramp into engagement. This motion pulls the sash tightly against the window frame generating compression for sealing the sash to the window frame.

To achieve this "flush," low profile appearance, the locking mechanism of the present invention introduces a longitudinal slot in a sidewall of the casing for the lock, wherein a fork component translates within the slot in a direction perpendicular to an axis of rotation of the handle, and the handle is rotatable along a plane perpendicular to the fork component. There is a restrictor arm for redirecting the pivot points of the handle to work in combination with a fork component to reduce the casing profile. As the fork component transitions horizontally along the elongated sidewall of the casement window lock, the pivot point of the handle and the restrictor arm shifts relative to the fork component to allow the handle to rotate approximately 150° from an initial position. In prior art designs, the handle directly drives a fork component or the tie bar—structural limitations that result in a higher profile appearance. In the present design, the handle is allowed to move more deeply into the lock mechanism to reduce the height of the lock casing.

Figure 14:
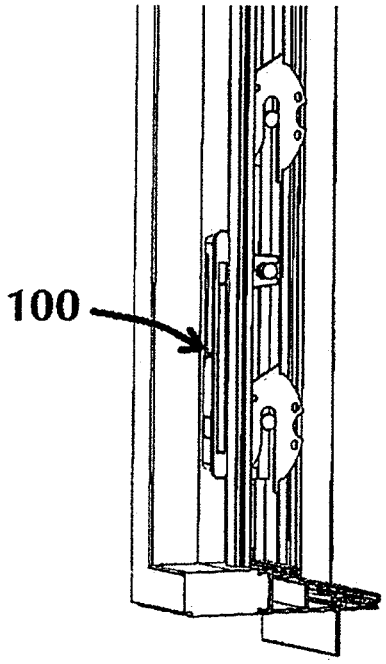
FIG. 14 is a perspective view of the flush lock handle mechanism casement window lock of the present invention installed in a window frame, with the handle in the locked position. A portion of the window trim has been removed to show the interconnection between the lock handle mechanism fork and the lock bar.
Figure 15:
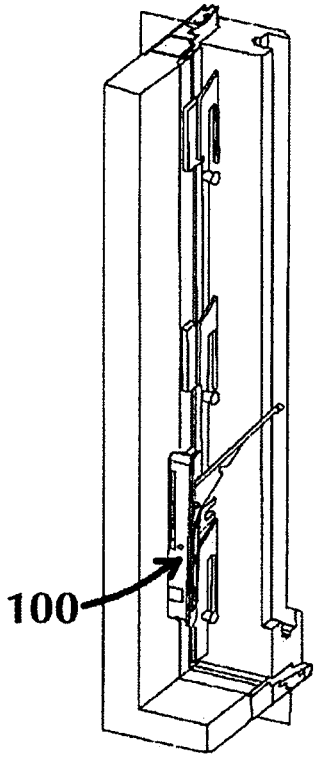
FIG. 15 is a perspective view of the flush lock handle mechanism casement window lock of FIG. 14, with the handle in the open position.

FIG. 1 depicts a perspective view of the flush lock mechanism 100 of the present invention, with the handle in a closed position. The lock is mounted to the frame of a casement window (FIGS. 14-15). Unique to the present invention is a longitudinal slot 14 in the sidewall of main casing 1 to accommodate the horizontal movement of fork component 5 by handle 7 that establishes the locking and unlocking functions. Fork component 5 translates within the slot 14 in a direction perpendicular to an axis of rotation of the handle 7, as the handle rotates along a plane perpendicular to the fork component 5. For exemplary purposes only, the elongated sidewalls of the casing will be deemed to be in a horizontal direction, and movement by fork component 5 will be considered movement in the horizontal direction. These assigned directions are provided only to facilitate descriptions regarding movement of components with respect to the casement window lock; they do not represent direction of the casement window lock after it is mounted on a window frame. (It is noted that casement window locks are generally mounted so that the elongated casing is positioned vertically, as shown in FIGS. 14-15.) A snap-on escutcheon 4, 4A covering the handle and internal components of the lock, respectively, presents a more aesthetically pleasing appearance when the flush lock mechanism is installed, for example, in a wooden frame for a window. The escutcheon may be colored or comprise a design pattern on a surface thereof to blend in or match the wood of the window frame.

FIG. 3 depicts a subassembly 120 of the flush lock mechanism of the present invention, with the escutcheon 4 and casing 1 removed, for clarity. As shown in FIG. 3, lock mechanism 100 includes a lever arm or handle 7, pivotable about a restrictor arm comprising sides 2A, 2B through a hinge or pivot pin 11 at an intermediate point of the handle.

Preferably, restrictor arm 2A, 2B is riveted to handle 7; however, other attachment schemes may be employed provided handle 7 is rotatably attached to restrictor arm 2A, 2B at the desired pivot location. Pivot pin 11 is preferably located at an intermediate point on handle 7 between the handle endpoints at a distance closer to the main casing 1 and escutcheon than the handle's grip portion end 16. This allows for greater mechanical leverage by a user when pulling handle 7 upwards or pushing handle 7 downwards. In an embodiment, as shown in FIG. 3, a spring action push mechanism 70 may be embedded in casing 4 near the handle grip portion 16. Push mechanism 70 acts to maintain the handle 7 in a flush position relative to the casing when handle is in the locked position, and to release the handle for rotation to the unlocked position, as will be described in further detail below. Flush lock handle mechanism 100, in its operating condition, is encased in snap-on escutcheon 4 and main casing 1. In FIG. 3, the snap-on escutcheon 4 has been removed for clarity.

FIG. 3 further illustrates the connection of handle 7 to restrictor arm 2A, 2B via pivot pin 11 at an intermediate point from each end of handle 7, as well as the connection of fork component 5 to an end of handle 7, rotatable about a hinge, pivot pin 10. As shown, handle 7 is designed to pivot about restrictor arm 2A, 2B and fork component 5 via pivot pins 10 and 11, respectively. Unlike the prior art, handle 7 is not directly connected to, nor does it pivot directly about, main casing 1 or escutcheon 4. As discussed further herein, this linkage contributes to the low profile design of the lock mechanism and the over center operation that prohibits back driving the flush lock mechanism.

Figure 9:
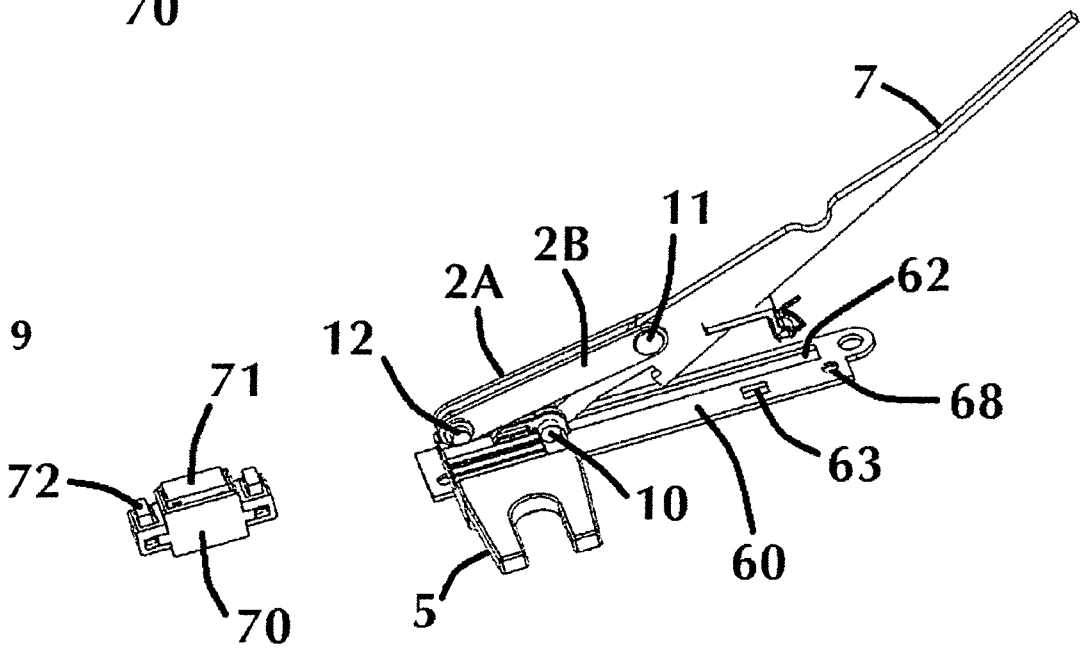
FIG. 9 is a right side perspective view of a sub-assembly of the flush lock mechanism of FIG. 8. The escutcheon and main casing have been removed, for clarity.
Figure 10:
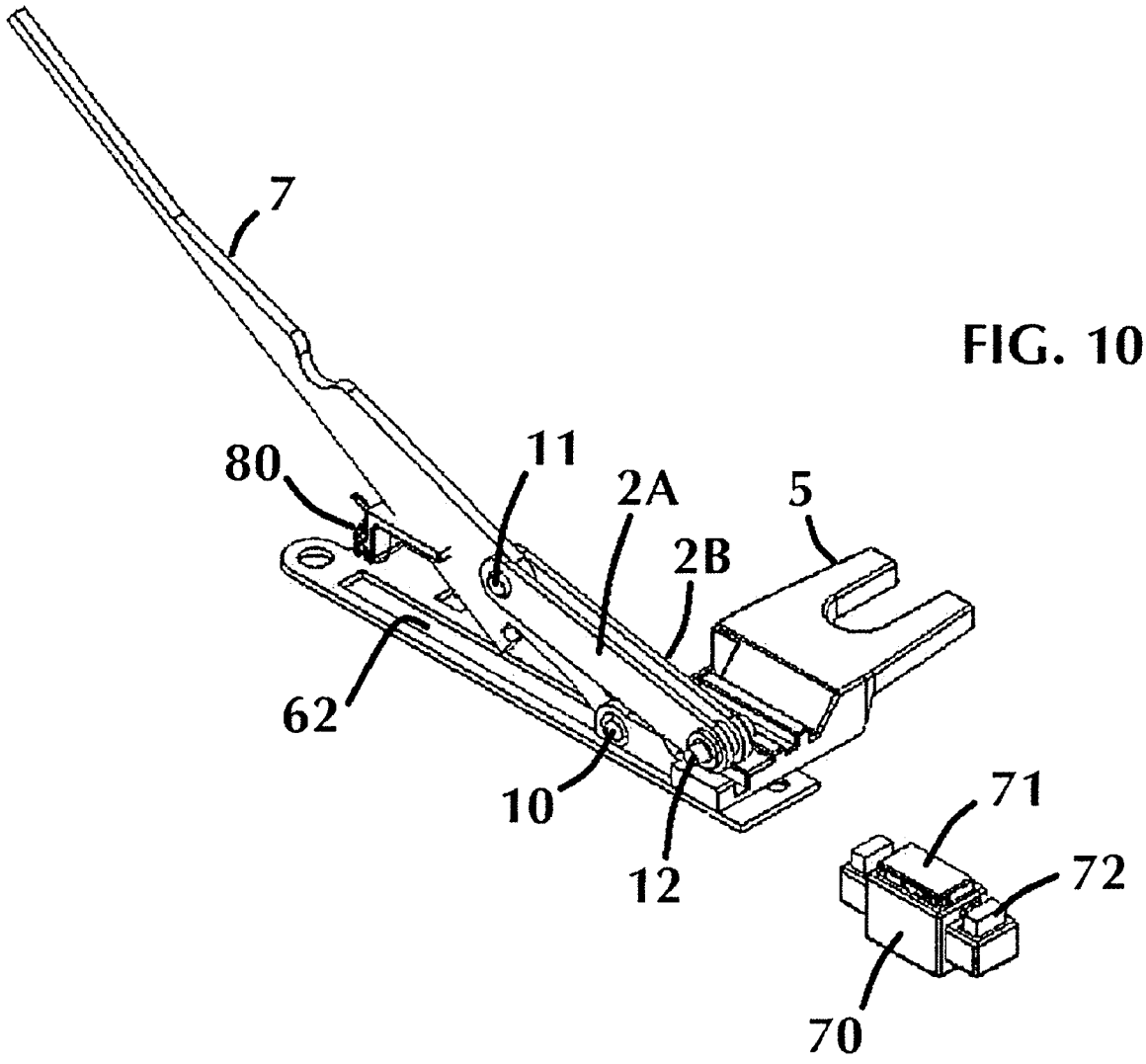
FIG. 10 is a left side perspective view of the sub-assembly of the flush lock mechanism of FIG. 9.
Figure 11:
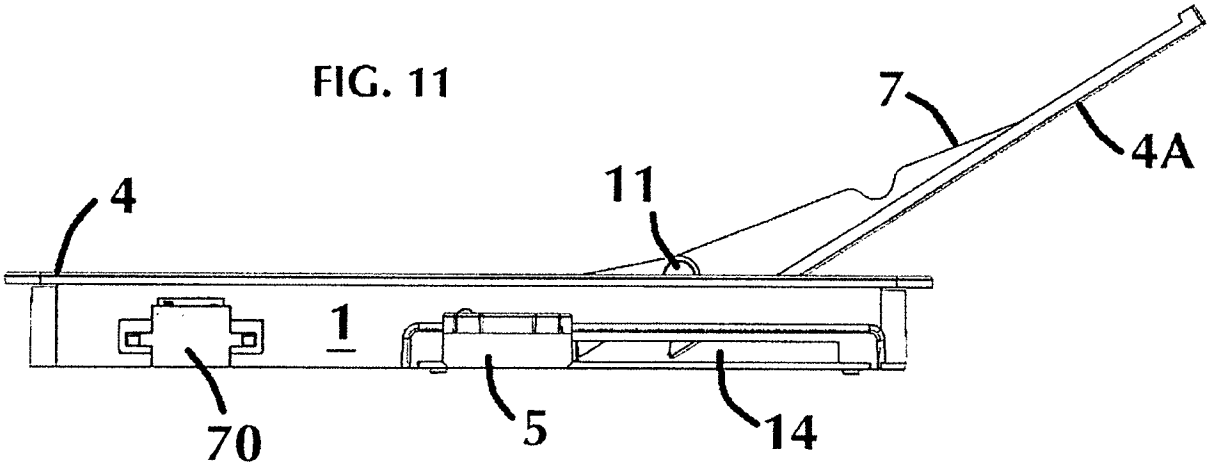
FIG. 11 is a right side plan view of the flush lock handle mechanism of FIG. 8, showing the fork translated within a longitudinal slot in the sidewall of the casing as the handle rotated to the open position.

A fork component 5 is employed that is similar to some prior art designs, insomuch as a fork component is used to engage a tie bar during locking and unlocking actuation. As shown in FIGS. 14-15, fork component 5 drives a tie bar or lock bar that is mounted to the frame. The tie bar engages a series of strikes that are mounted to the moving sash. Once the tie bar is engaged with the strikes, the window is locked. One end of handle 7 pivotally connects to fork component 5 via hinge or pivot pin 10, which may be a rivet or other rotatable, pivoting attachment. The opposite end of restrictor arm 2A, 2B is pivotally connected to casing 1 via hinge or pivot pin 12. Upon actuation of the handle 7, as the fork component 5 transitions horizontally within slot 14 along the elongated sidewall of the casement window lock, the pivot pin 11 connecting the handle and restrictor arm shifts vertically, as well as transversely, relative to pivot pin 10 to allow the handle to rotate from an initial position. In one embodiment, handle 7 is permitted to rotate approximately 150° from its initial position, as shown in FIG. 9.

FIG. 2 is an exploded view of the flush lock handle mechanism 100. Fork component 5 includes an extension or protrusion 6, protruding from said fork component body for engaging longitudinal slot 14 in the sidewall of the casing. As further shown, fork component 5 may include a track segment 8 on its body that receives an extension or lip protruding from the top portion of slot 14. Handle 7 is received between two raised portions of fork extension 6, each raised portion comprising an aperture for receiving pivot pin 10 therethrough to pivotally connect handle 7 to fork component 5 (FIGS. 3-4).

Figure 4:
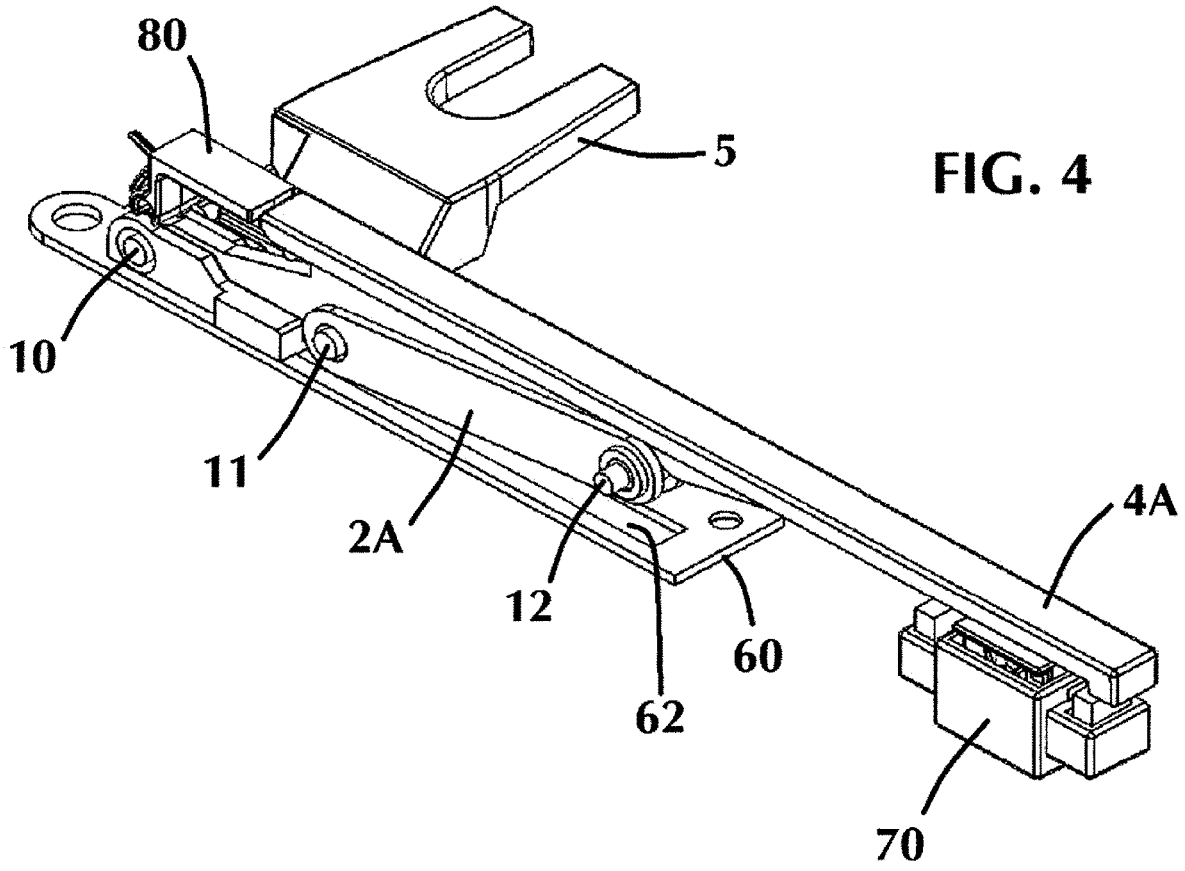
FIG. 4 is a left side perspective view of the sub-assembly of the flush lock mechanism of FIG. 3.

FIG. 4 depicts a left side perspective view of the subassembly of the flush lock mechanism shown in FIG. 3, with a snap-on escutcheon 4A shown covering the top portion of handle 7. As shown in FIGS. 3-4, the subassembly may further include a spring action magnetic push mechanism 70 for maintaining the handle in flush position relative to the casing 1 when in a locked position. Embedded in the push mechanism is spring action pedestal 71 and at least one permanent magnet 72 having a polarity opposite permanent magnet 73 which may be embedded in an end of handle 7 opposite pivot pin 10 (FIG. 9). The distance, and therefore the strength of magnetic attraction, between magnets 72, 73 is such that to release the handle for rotation, a user may pulse the end 16 of the handle downward in the direction of casing 1 to compress spring pedestal 71, and upon release, the energy stored in the compressed spring upon returning to its normally biased state is sufficient to overcome the magnetic attraction between magnets 72, 73, resulting in handle 7 being freely rotatable after being biased upwards by the spring action pedestal 71.

Figure 5:
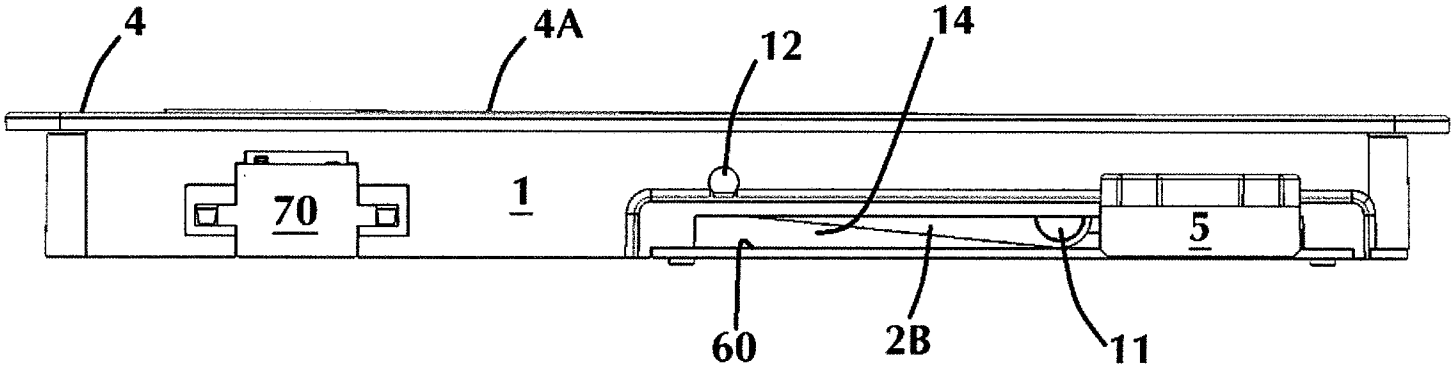
FIG. 5 is a right side plan view of the flush lock handle mechanism of FIG. 1, showing the fork translatable within a longitudinal slot in the sidewall of the casing in a direction perpendicular to the axis of rotation of the handle.

FIG. 5 depicts a side plan view of the flush lock handle mechanism of the present invention. Handle 7 is in the locked position and maintained flush within casing 1 by the magnetic attraction between magnets 72, 73. Fork component 5 is shown in its right most position prior to translation within longitudinal slot 14 in the sidewall of the casing 1 as the handle rotates along a plane perpendicular to the fork to open the lock. As shown in FIG. 2, fork component 5 includes an extension or protrusion 6, protruding from said fork component body in a direction perpendicular to the horizontal motion of travel of fork component 5 that may be a pin or a slightly elongated oval or rectangular shaped segment for slidably engaging longitudinal slot 14. Extension or protrusion 6 may be integral with, or attached to, fork component 5. As shown in FIG. 2, in an embodiment, fork component 5 may include a track segment 8 on its body that receives an extension or lip protruding from the top portion of slot 14. In either attachment scheme, fork component 5 is able to slide horizontally in slot 14 along the elongated horizontal casing structure when induced by the actuation of handle 7.

The relationship between the hinged points of the present invention interplays with the translation of the motion of handle 7 and fork component 5.

Figure 6:
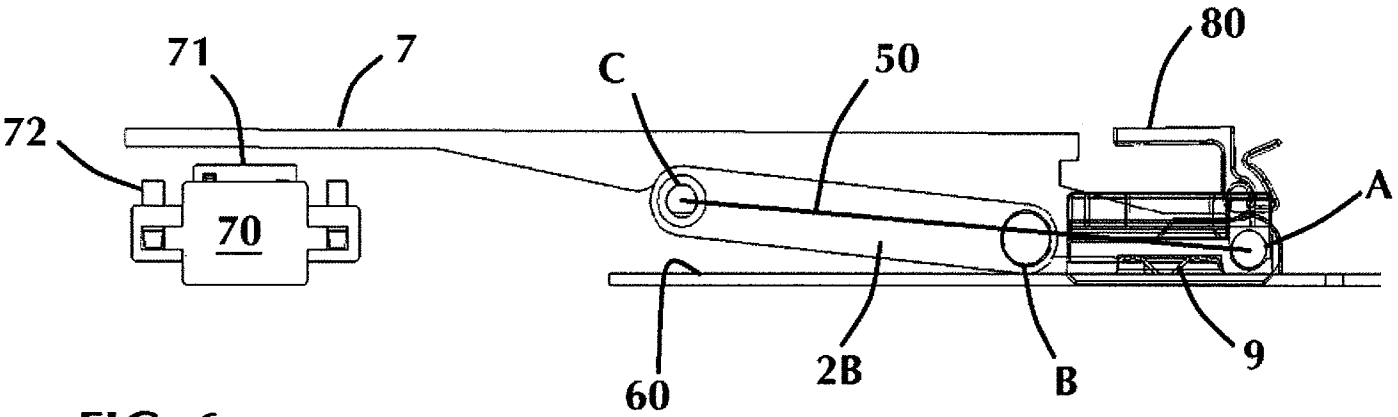
FIG. 6 is a right side plan view of the flush lock handle mechanism of FIG. 5, with the casing removed to show the positioning of over center linkage including three hinge points depicted with the handle in the closed position.

As shown in FIG. 6, hinge A or pivot 10 is the pivotal junction of handle 7 and fork component 5. Hinge B or pivot 11 is the pivotal junction of handle 7 with restrictor arm 2A, 2B at an intermediate point on handle 7. Hinge C or pivot 12 is the pivotal junction of restrictor arm 2A, 2B with the casing, as shown in FIG. 5.

FIG. 6 is a cross-sectional view of the lock mechanism of the present invention with main casing 1 removed, depicting the positioning of three hinge points A, B, C when handle 7 is in the locked position. Hinge B is shown below the line of action 50 between hinges A and C. This relationship allows for the locking mechanism to utilize over center linkage at the ends of travel, and prevents the system from being back-driven (i.e., someone trying to break into the window by reversing the locking mechanism). Since hinge B is below the line of action 50 between hinges A and C, the system is not back drivable. In this manner, this configuration produces a "three bar linkage" design. It also allows handle 7 to move over a very wide operating angle and return to a flush or low profile position. The first of the three bar links is formed by handle 7 between the pivot 10 (hinge A) connected at fork component 5 and pivot 11 (hinge B) connected at restrictor arm 2A, 2B. A second bar or link is formed by restrictor arm 2A, 2B and pivots at each end thereof (hinges B and C). The third bar or link of the three bar linkage is created by fork component 5 (hinge A) and the horizontal sliding motion of fork 5 component relative to the fixed pivot point 12 of the restrictor on the body of the casing (hinge C). The three bar linkage uses these three links pivotally connected at the ends (pivot points) so that the three links can move relative to each other.

When handle 7 is at either end of its travel, the three bar linkage design moves one pivot or hinge on the handle to an over center position relative to the two other pivot or hinge points. This over center position prevents the tie bar or lock bar from being back driven to the unlocked position when an "opening" force is applied to rotate handle 7. As shown in FIG. 6, when handle 7 is down (or in the locked position), the pivot connection (hinge B) between handle 7 and restrictor arm 2A, 2B will be below line of action 50 defined between the pivot point of the handle and fork component (hinge A) and the fixed pivot point between the restrictor arm and the casing body (hinge C).

Figure 12:
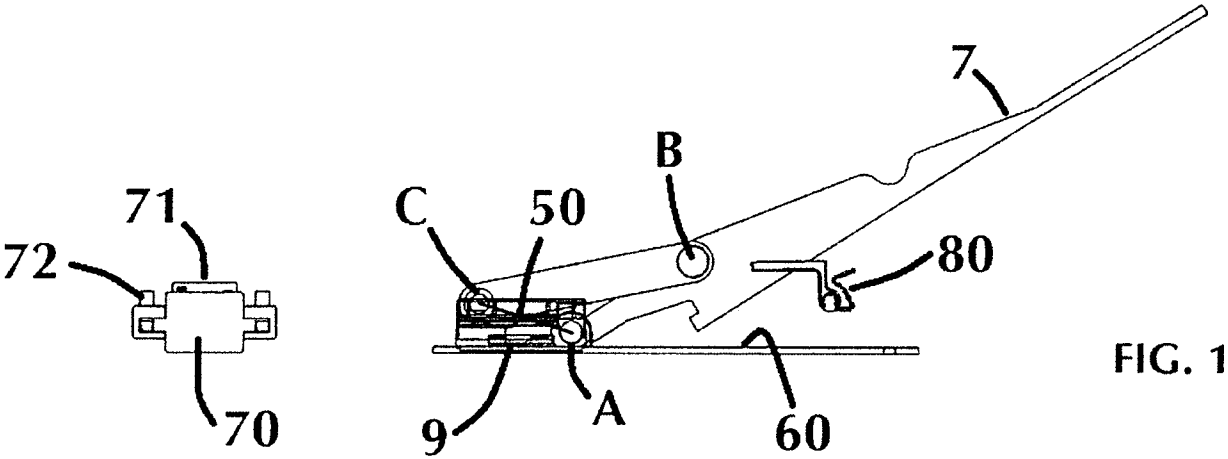
FIG. 12 is a right side plan view of the flush lock handle mechanism of FIG. 11, with the casing removed to show the positioning of over center linkage including three hinge points depicted with the handle in the open position.

At the other extreme, as shown in FIG. 12 with handle 7 fully open, the second pivot connection on the handle (the pivot point on restrictor arm, hinge B) will have moved past and above the line of action 50 defined between the first pivot point on the handle at the fork component (hinge A) and the fixed pivot point between the restrictor arm and the body of the casing (hinge C). In each case, a hinge point moves "over center" to prevent the lock mechanism from being reverse driven. In other words, one of the three pivot points moves across a line of action that connects two other pivot points.

FIGS. 8-12 depict the handle 7 in a fully opened position. In a preferred embodiment, pivot pin 11 or hinge B gradually shifts vertically, as well as transversely, from the horizontal over the length of travel as the fork component moves horizontally within slot 14 along main casing 1, perpendicular to the axis of rotation of the handle, as the handle rotates from a locked to an unlocked position. Without such rising, a binding condition would be experienced as the fork component is moved through its horizontal transition. Thus, in the preferred embodiment, actuating handle 7 serves to move pivot pin 11 simultaneously to a raised (or lowered) position while the fork component 5 is moved horizontally within slot 14, as the handle rotates between locked and unlocked positions. This allows handle 7 "clearance" to rotate about its pivot points without requiring extra depth to the casing, and in fact, reducing the depth of the casing, making the casement window lock more flush with the mounting frame.

Figure 8:
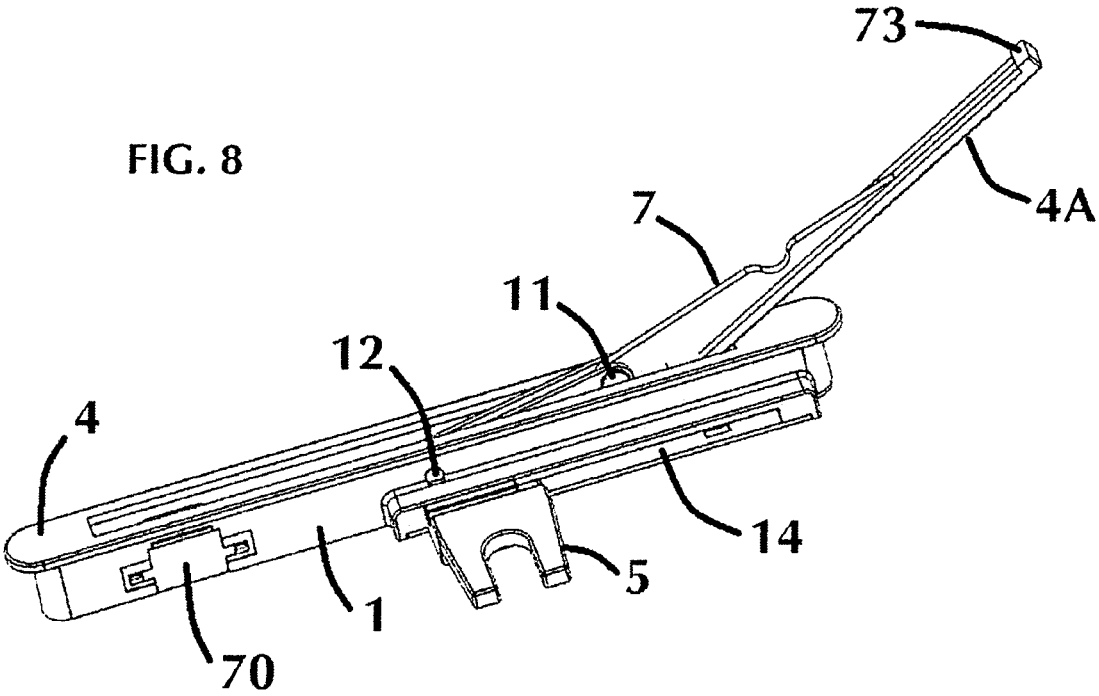
FIG. 8 is a perspective view of an embodiment of the flush lock handle mechanism casement window lock of the present invention, with the handle in the fully opened position.

As further shown in FIGS. 8-12, in an embodiment, the present invention includes a rotatable connector 80 for preventing the handle 7 from over-rotating and contacting escutcheon or casing. As the handle is rotated to an open position, connector 80 acts as a stop to prevent handle 7 from rotating into escutcheon 4 and ensuring clearance therebetween (FIG. 8).

In order to assemble the lock mechanism to the frame of a window, a retainer 60 is used. Retainer 60 provides a surface for mounting screws to bear down on.

Referring again to FIG. 2, and also shown in FIGS. 3-4 and 9-10, is an embodiment of the retainer 60 of the present invention. Retainer 60 is an elongated, flush component, having a slot or track 62 extending along a length thereof for receiving a portion of fork component 5 when the fork component translates within casing slot 14 as handle 7 is rotated between open and closed positions. Retainer 60 further includes a pair of indentations 63 indicating the ends of travel of the fork component 5 as the handle is rotated. Two screw holes 68 are introduced at approximately each end for mounting the flush lock mechanism.

In an embodiment of the present invention, there is a detent at both ends of travel (open and locked). A detent spring 9 (refer to FIG. 2) is located underneath fork component 9, between the fork component and retainer 60. Detent spring 9 provides tactile and audible indication that the lock mechanism has reached its end of travel. Additionally, a detent helps sustain handle 7 in the correct position at its end of travel.

FIGS. 2-7 and 9-13 depict a retainer 60 having preferred shaped detents 63 to receive and accommodate detent spring 9 as fork component 5 translates within slot 14.

Figure 7:
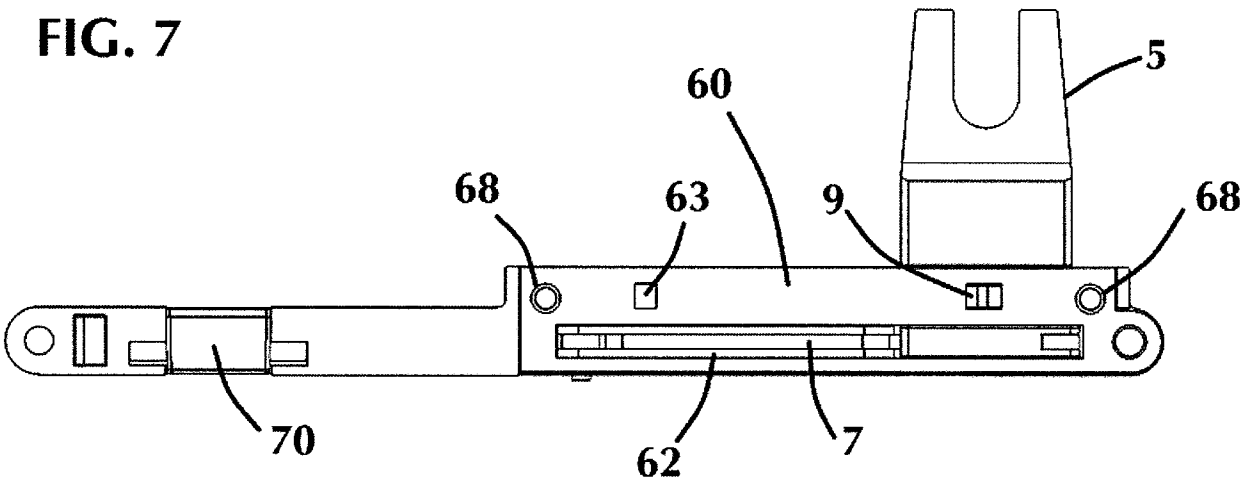
FIG. 7 is a bottom plan view of the flush lock handle mechanism of FIG. 1.
Figure 13:
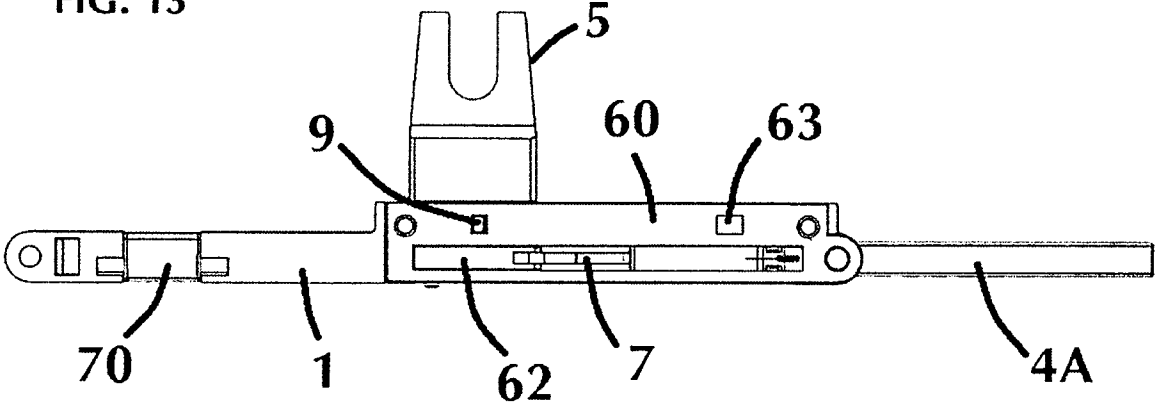
FIG. 13 is a bottom plan view of the flush lock handle mechanism of FIG. 8.

FIG. 7 depicts a bottom plan view of the lock mechanism in the locked detent position (detent spring 9 is engaged with the right-sided indentation or detent 63) when the handle is in the locked position, while FIG. 13 depicts a bottom plan view of the lock mechanism in the unlocked detent position (detent spring 9 is engaged with the left-sided indentation or detent 63) when the handle is in the unlocked position.

To further assist with handle stability during operation, a spring washer 3 is preferably employed between restrictor arm 2 and main casing 1 (FIGS. 2-3). This spring washer, preferably a Belleville spring washer, is capable of providing large amounts of force with very little deflection, thus allowing the present invention to provide upwards of 75 pounds of load with two-tenths of one millimeter (0.2 mm) of deflection. Spring washer 3 also accommodates production variances while maintaining a pre-load force on restrictor arm 2.

FIG. 3 depicts a partial perspective view of the subassembly showing spring washer 3 in position.

The present invention achieves a low profile casement window lock that far exceeds the profile depth of casement window locks of the prior art by introducing a longitudinal slot in a sidewall of the casing for the lock, wherein the fork component translates within the slot in a direction perpendicular to an axis of rotation of the handle as the handle rotates along a plane perpendicular to the fork component. The present invention establishes a locking structure with multiple pivoting points that allows the handle to rotate completely with minimally required clearance in the casing housing. The pivoting action of the handle and restrictor arm allows the handle to move the fork component horizontally while raising or lowering the restrictor arm pivot pin in relation to the fork component, with the fork component in slidable communication with a longitudinal slot in a sidewall of the casing. The multiple pivoting action provides for a three bar linkage that secures the casement window lock in either the open, unlocked position, or closed, locked position, and prevents back driving the lock mechanism in the reverse direction.

While the present invention has been particularly described, in conjunction with specific embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

1. A method of unlocking a casement window having:

an elongated casing with a substantially horizontal sidewall section, the sidewall section including a longitudinal slot for receiving a fork component;

a restrictor arm pivotally attached at one end to said casing, and pivotally attached at the other end to a handle at a first pivot point;

a fork component adapted to engage a lock bar external to said lock, said fork component in slidable communication with said casing within said longitudinal slot;

a handle pivotally attached at one end to said fork component at a second pivot point and pivotally attached at an intermediate point on said handle to said restrictor arm, said handle rotatable along a plane perpendicular to said fork component, said handle including a second end having a first permanent magnet embedded therein; and a spring action push mechanism including a second permanent magnet of opposite polarity to said first permanent magnet embedded in the casing at an end opposite the handle second pivot point, wherein magnetic attraction between the permanent magnets maintains the handle in a flush position within the casing when the handle is in a locked position;

and said method comprising:

pulsing said handle second end in the direction of the casing to compress a spring within the push mechanism such that upon release of the spring, energy stored in the compressed spring is sufficient to overcome the magnetic attraction between said first and second permanent magnets to release said handle for rotation; and rotating said handle about said first pivot point to move said fork component and said second pivot point horizontally along said casing horizontal sidewall section within said longitudinal slot in a direction perpendicular to an axis of rotation of the handle, while simultaneously shifting said first pivot point relative to said second pivot point to allow said handle to rotate from an initial position.

2. The method of claim 1 including causing an over-center condition by rotating said handle from a fully unlocked position such that:

a first hinge point, rotatably joining said handle to said fork component, is placed between a second hinge point, rotatably joining said handle to said restrictor arm, and a third hinge point, rotatably joining said restrictor arm to said casing, and said second hinge point is above an action line connecting said first and third hinge points;

and causing said over-center condition by rotating said handle fully to a locked position such that said second hinge point is placed between said first and third hinge points, and said second hinge point is below an action line connecting said first and third hinge points.

3. A method of securing a window sash to a casement window frame, said method comprising:

actuating a flush lock for said casement window, wherein said casement window includes an elongated casing having a substantially horizontal sidewall section, the sidewall section including a longitudinal slot for receiving a fork component, and said flush lock includes:

a fork component adapted to engage a lock bar external to said lock, said fork component in slidable communication with said casing within said longitudinal slot;

a restrictor arm pivotally attached to said casing;

a plurality of hinges or pivot points forming an over center linkage to prevent back driving said lock, wherein said over center linkage includes:

a first hinge point rotatably joining said handle to said fork component;

a second hinge point rotatably joining said handle to said restrictor arm;

a third hinge point rotatably joining said restrictor arm to said casing;

a handle pivotally attached at one end to said fork component, and pivotally attached at an intermediate point on said handle to said restrictor arm, said handle rotatable along a plane perpendicular to said fork component;

rotating said handle to an unlocked position, such that said first hinge point is between said second and third hinge points, and said second hinge point is above an action line connecting said first and third hinge points; or rotating said handle to a locked position, such that said second hinge point is between said first and third hinge points, and said second hinge point is below an action line connecting said first and third hinge points; and moving said fork component horizontally along said casing horizontal sidewall section within said longitudinal slot in a direction perpendicular to an axis of rotation of said handle.

4. A casement window lock for securing a window sash to a casement window frame, said lock comprising:

a casing having a substantially horizontal sidewall section, the sidewall section including a longitudinal slot;

a restrictor arm pivotally attached at one end to said casing, and pivotally attached at the other end to a handle at a first pivot point;

a fork component including an attachment portion for engaging a lock bar and a protrusion for slidably engaging said longitudinal slot; and a handle in pivotal communication with said fork component at one end of said handle at a second pivot point, and in pivotal communication with said restrictor arm at an intermediate point on said handle, said handle rotatable along a plane perpendicular to said fork component; and a plurality of hinges or pivot points forming an over center linkage to prevent back driving said lock, said over center linkage including:

a first hinge point rotatably joining said handle to said fork component;

a second hinge point rotatably joining said handle to said restrictor arm; and a third hinge point rotatably joining said restrictor arm to said casing;

wherein, when said handle is rotated to an unlocked position, said handle pivots about said first pivot point, causing said fork component and said second pivot point to traverse horizontally within said longitudinal slot in a first direction perpendicular to an axis of rotation of the handle, and when said handle is rotated to a locked position, said handle pivots about said first pivot point in an opposite direction, causing said fork component and said second pivot point to traverse horizontally within said, longitudinal slot in a second direction opposite said first direction, and wherein, when said handle is in an unlocked position, said first hinge point is between said second and third hinge points, and said second hinge point is above an action line connecting said first and third hinge points, and when said handle is in a locked position, said second hinge point is between said first and third hinge points, and said second hinge point is below an action line connecting said first and third hinge points.

5. The casement window lock of claim 4 further including a retainer for securing said lock to a window frame, wherein said retainer is placed on a window frame opposite said casement window lock and providing a surface for mounting screws through said window frame to said lock.

6. The casement window lock of claim 5 wherein said retainer comprises a slot extending along a length thereof for receiving at least a portion of said fork component extending therethrough as said fork component traverses in said first and second directions.

7. The casement window lock of claim 5 wherein said retainer comprises at least one detent formed therein to engage a detent spring coupled to said fork component and located between said fork component and said retainer, said detent spring providing tactile and audible indication that said fork component has reached an end of travel.

8. The casement window lock of claim 4 further including a spring washer attached between said restrictor arm and said casing, said spring washer capable of providing force at minimal deflection.

9. The casement window lock of claim 4 further comprising a spring action push mechanism including a permanent magnet embedded in the casing at an end opposite the handle second pivot point and the handle includes a second end having a permanent magnet of opposite polarity to said first permanent magnet embedded therein, and wherein magnetic attraction between the permanent magnets maintains the handle in a flush position within the casing when the handle is in a locked position.

10. The casement window lock of claim 9 wherein said handle is releasable for rotation by pulsing an end of said handle in the direction of the casing to compress a spring within the push mechanism such that upon release of the spring, energy stored in the compressed spring is sufficient to overcome the magnetic attraction between said first and second permanent magnets.

11. The casement window lock of claim 4 further including a snap-on escutcheon attached to said casing and said handle.

12. The casement window lock of claim 4 further including a rotatable connector for preventing said handle from over-rotating and contacting said casing and ensuring clearance therebetween as said handle is rotated to an unlocked position.

* * * * *